US006572344B1

(12) United States Patent
Hajek, Jr. et al.

(10) Patent No.: US 6,572,344 B1
(45) Date of Patent: Jun. 3, 2003

(54) COMPACT PUMP OR MOTOR WITH INTERNAL SWASH PLATE

(75) Inventors: Thomas J. Hajek, Jr., Lockport, IL (US); David P. Smith, Joliet, IL (US)

(73) Assignee: Caterpillar Inc, Peoria, IL (US)

( * ) Notice: Subject to any disclaimer, the term of this patent is extended or adjusted under 35 U.S.C. 154(b) by 0 days.

(21) Appl. No.: 09/994,158

(22) Filed: Nov. 26, 2001

(51) Int. Cl.[7] ..... F04B 1/12; F04B 7/00; F04B 1/00; F01B 3/00

(52) U.S. Cl. ..... 417/269; 92/71; 417/512; 417/517; 417/524

(58) Field of Search ..... 417/269, 499, 417/512, 517, 524; 92/71

(56) References Cited

U.S. PATENT DOCUMENTS 2,821,932 A * 2/1958 Lucien ..... 417/269
3,981,630 A * 9/1976 Leduc et al. ..... 417/269
4,522,112 A * 6/1985 Nomura ..... 92/71
5,220,225 A * 6/1993 Moon, Jr. ..... 310/87
5,396,768 A 3/1995 Zulu
5,415,596 A 5/1995 Zulu
5,423,183 A * 6/1995 Folsom ..... 60/492
5,545,098 A 8/1996 Zulu
6,179,574 B1 * 1/2001 Yie ..... 417/269

* cited by examiner

*Primary Examiner*—Timothy S. Thorpe
*Assistant Examiner*—Timothy P. Solak
(74) *Attorney, Agent, or Firm*—J. W. Burrows; Steve M Hanley

(57) ABSTRACT

A fluid translating device is provided that includes a first member having fluid inlet/outlet ports and a second member having a plurality of pistons disposed therein secured to a stationary central shaft. A camplate and port plate is disposed in the fluid translating device about the stationary central shaft and located between the first and second members. The camplate is in communication with the fluid inlet/outlet ports and the plurality of pistons is in mating contact with the port plate. An outer input/output member is secured about the camplate and is rotatably disposed about the first and second members to form a compact arrangement.

26 Claims, 5 Drawing Sheets

COMPACT PUMP OR MOTOR WITH INTERNAL SWASH PLATE

TECHNICAL FIELD

This invention relates generally to fluid translating units and more particularly to a compact fluid translating device and the use thereof in a fluid system.

BACKGROUND

Fluid translating units are well known in the art. They may be designed to function as a fluid pump or a fluid motor. Typically, in the axial piston units, they have a stationary housing having a fluid inlet port, a fluid outlet port, an internal rotating unit connected to an input/output shaft, a cam/swash plate and internal porting to meter the fluid flow therethrough. The rotating unit normally includes a rotating barrel having a plurality of piston assemblies slideably disposed therein in contact with the cam/swash plate. Due to the outer stationary housing, these known fluid translating units are normally somewhat bulky and require additional space when space may be very limited. Additionally, the known axial fluid translating units are limited, based at least in part on the piston assemblies, in their angular displacement. In many of the known designs, the input/output shaft is cantilevered and loads applied thereto tend to cause premature bearing failures. There are some fluid translating motors that rotate the outer portion of the motor at the same time that the translating unit is being rotated. These arrangements require, in most cases, the use of radial fluid translating units and have additional length due to the output shaft extending from both ends. One such example is set forth in U.S. Pat. No. 5,396,768 issued to Joshua Zulu on Mar. 14, 1995.

The present invention is directed to overcoming one or more of the problems set forth above.

SUMMARY OF THE INVENTION

In one aspect of the present invention, a fluid translating device is provided and comprises a stationary central shaft, first and second members, a camplate, a port plate, a plurality of pistons, and an outer input/output member. The stationary central shaft has first and second end portions and a center portion with a reference axis extending through the first, second, and center portions. The first member is securely connected to the first end portion of the stationary central shaft about the reference axis and has an end face and first and second inlet/outlet ports in communication with the end face thereof. The second member is securely connected to the second end portion of the stationary central shaft about the reference axis and has a face surface and a plurality of equally spaced blind bores defined therein about the reference axis and the plurality of blind bores extends from the face surface thereof parallel to the reference axis. The camplate is rotatably disposed about the reference axis of the stationary central shaft between the first and second members and has a first end face portion in abutting contact with the end face of the first member and a second end face portion angled with respect to the reference axis and has a recess defined therein. A face surface is disposed in the recess and the face surface therein is in communication with the first end face portion thereof. The port plate has a bearing assembly disposed thereabout and is located within the recess of the camplate. The port plate has first and second opposed faces and a plurality of equally spaced formed cavities defined therein about the reference axis between the first and second opposed faces. The port plate is positioned with the first opposed face thereof being in mating contact with the face surface of the recess in the camplate. Each piston of the plurality of pistons has first and second end portions with the first end portion being slideably disposed within the respective blind bores of the second member to define pressure chambers therein and the second end portion thereof is in contact with the other opposed face of the port plate. The outer input/output member is disposed about the camplate and the first and second members and the outer input/output member is secured to the camplate and rotatable about the first and second members.

DETAILED DESCRIPTION

Figure 1:
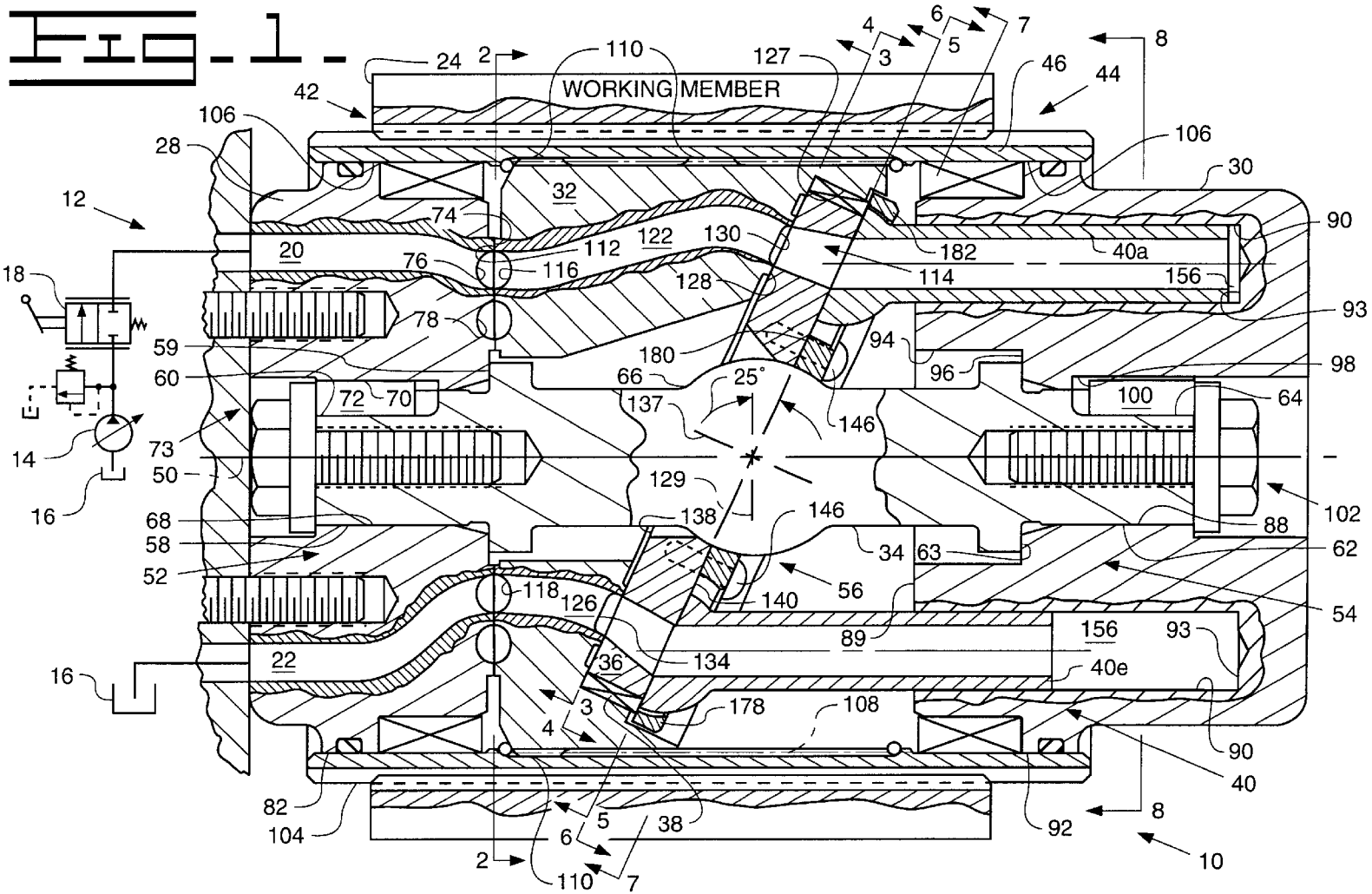
FIG. 1 is a partial diagrammatic and partial schematic sectional view of an embodiment of the present invention used as a fluid motor in a fluid system.
Figure 2:
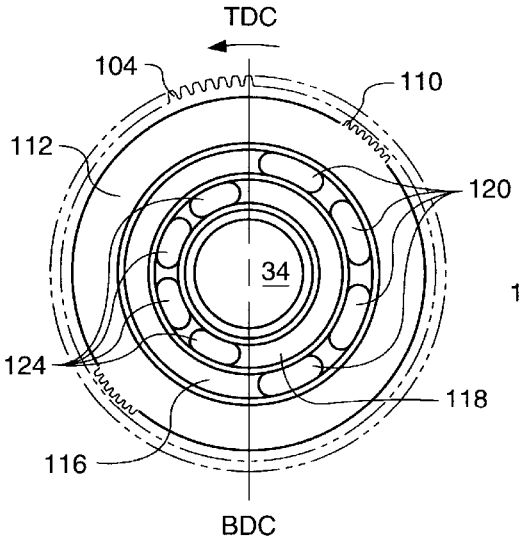
FIG. 2 is a sectional view taken along the line 2—2 of FIG. 1.

Referring to the embodiment of FIG. 1, a fluid translating device 10 is illustrated in a fluid system 12. As used in the fluid system 10 of FIG. 1, the fluid translating device 10 is operating as a fluid motor and, with respect to FIGS. 1–11, will be referred to as a fluid motor. It is recognized that the fluid translating device 10 could also be a fluid pump as will be set forth later with respect to the fluid system of FIG. 12. All elements of the fluid motor 10, as hereinafter described with respect to FIG. 1–11, will apply equally to the same elements when used as a fluid pump 10. The fluid system 12 also includes a source of fluid, such as, a hydraulic pump 14 that receives fluid from a reservoir 16 and delivers pressurized fluid through a control valve 18 to a first inlet/outlet port 20 of the fluid motor 10. A second inlet/outlet port 22 is connected to the reservoir 16. It is recognized that the first and second inlet/outlet ports 20,22 could be connected to the fluid motor through known SAE ports or other known connections. The fluid motor 10 is also drivingly connected to a working member 24. The working member 24 could be a fan for cooling, a final drive for a wheel or any other well known devices that are driven by fluid motors.

The fluid motor 10 includes first and second members 28,30, a camplate 32, a stationary central shaft 34, a port plate 36 with a bearing assembly 38 disposed thereabout, a plurality of pistons 40, first and second seal and bearing assemblies 42,44, and an outer input/output member 46.

The stationary central shaft 34 defines a reference axis 50 and has a first end portion 52, a second end portion 54 and a center portion 56. The first end portion 52 includes a diameter 58 of a predetermined size extending from the end thereof to a shoulder 59 and has a keyway 60 defined therein. The second end portion 54 includes a diameter 62 of a predetermined size extending from the end thereof to a shoulder 63 and has a keyway 64 defined therein. The center portion 56 includes an enlarged spherical surface 66.

The first member 28 has a bore 68 defined therein and of a size to receive the diameter 58 of the first end portion 52 of the stationary central shaft 34. A keyway 70 is defined in the bore 68 and a key 72 is disposed in the respective keyways 60,70 to locate the first member 28 relative to the first end portion 52 of the stationary central shaft 34. The first member 28 is disposed about the first end portion 52 of the stationary central shaft 34 and an end face 74 thereof abuts the shoulder 60 and secured thereto by a fastener mechanism 73.

The end face 74 of the first member 28 is perpendicular with the reference axis 50 and is in communication with the first and second inlet/outlet ports 20,22. The first member 28 has a first circular groove 76 defined in the end face 74 about the reference axis 50. The first circular groove 76 is disposed about the reference axis 50 at a predetermined radius. A second circular groove 78 is defined in the first member 28 about the reference axis 50 at the face surface 74. The second circular groove 78 is disposed about the reference axis 50 at a predetermined smaller radius. The first circular groove 76 is in communication with the first inlet/outlet port 20 and the second circular groove 78 is in communication with the second inlet/outlet port 22.

The first seal and bearing assembly 42 is disposed within grooves/slots of a peripheral surface 82 of the first member. In the subject embodiment, the first seal and bearing assembly 42 includes a seal 84 and a bearing mechanism 86. It is recognized that other known seal and bearing arrangements could be used.

The second member 30 has a bore 88 defined therein about the reference axis 50, a face surface 89, a plurality of blind bores 90 defined therein a predetermined distance away from and about the reference axis 50 and extends from the end face 89 thereof parallel to the reference axis 50 to a bottom surface 93, and a peripheral surface 92. A cavity 94 is defined in the second member 30 extending from the face surface 89 to form a shoulder 96 therein.

A keyway 98 is defined in the bore 88 and a key 100 is disposed in the respective keyways 64,98 to locate the first member 28 relative to the second end portion 54 of the stationary central shaft 34. The second member 30 is disposed about the second end portion 54 of the stationary central shaft 34 and the shoulder 96 of the second member 30 abuts the shoulder 63 and secured thereto by a fastener mechanism 102.

The second seal and bearing assembly 44 is disposed within grooves/slots of the peripheral surface 92 of the second member 30. In the subject embodiment, the second seal and bearing assembly 44 is the same as the first seal and bearing assembly 42 described above.

The outer input/output member 46 is ratatably disposed about the first and second members 28,30 and in driving contact with the working member 24 through a spline tooth arrangement 104 disposed on the outer peripheral thereof. It is recognized that the working member 24 could be made integral with the outer input/output member 46 without departing from the essence of the subject invention. The outer input/output member 46 has a bore 106 defined therein and operative at respective ends thereof to engage the respective first and second seal and bearing assemblies 42,44. The center portion of the bore 106 has a drive engaging portion 108, such as spline teeth to drivingly mate with the camplate 32.

The camplate 32 is disposed within the outer input/output member 46 and is driving connected thereto through a drive engaging portion 110, such as spline teeth. The drive engaging portion 110 of the camplate 32 and the drive engaging portion 110 are of a size and shape sufficient to center and align the camplate 32 within the outer input/output member 46. It is contemplated that, if desired, the camplate 32 could be made integral with the outer input/output member 46.

The camplate 32 has first and second end face portions 112,114 and encircles the center portion 56 of the stationary central shaft 34. The first end face portion 112 is in abutting contact with the end face 74 of the first member 28. The first end face portion 112 has a first circular groove 116 defined therein about the reference axis 50. The first circular groove 116 is disposed about the reference axis 50 at a predetermined radius. A second circular groove 118 is defined in the first end face portion 112 about the reference axis 50. The second circular groove 118 thereof is disposed about the reference axis 50 at a predetermined smaller radius. The first circular groove 116 is adjacent to and mates with the first circular groove 76 of the first member 28 and the second circular groove 118 is adjacent to and mates with the second circular groove 78 of the first member. Referring to the cross section of FIG. 2, which illustrates the first end face portion 112 of the camplate 32, arcuate slots 120 are defined in the first end face portion 112 extending from the first annular groove 116 into the first end face portion 112 to form a passageway 122 (FIG. 1). Likewise, arcuate slots 124 are defined in the first end face portion 112 extending from the second annular groove 118 into the first end face portion 112 to form passageway 126 (FIG. 1).

Figure 3:
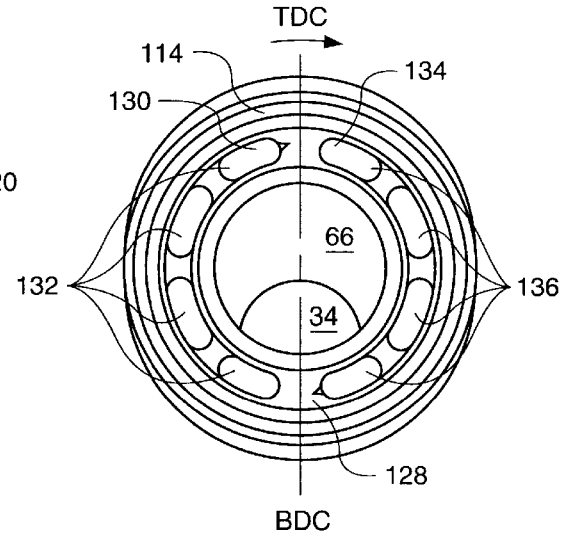
FIG. 3 is a sectional view taken along the line 3—3 of FIG. 1.

In the subject embodiment, a recess 127 is defined in the second end face portion 114 of the camplate 32 and forms a face surface 128. The face surface thereof is angled at an acute angle of 25 degrees with respect to the first end face portion 112 and a reference plane 129. The acute angle could readily be in the range of 10 to 35 degrees without departing from the essence of the subject invention. Referring to the cross section of FIG. 3 which illustrates the face surface 128 of the second end face portion 114, a first arcuate groove 130 formed by a plurality of interconnected arcuate slots 132 is defined in the face surface 128 on one side thereof and extends into the second end face portion 114 and connects with passageway 122 (FIG. 1). A second arcuate groove 134 formed by a plurality of interconnected arcuate slots 136 is defined in the face surface 128 on the opposed side thereof and extends into the second end face portion 114 and connects with passageway 126 (FIG. 1). The first and second arcuate grooves 130,134 are each disposed at a predetermined radius about a second reference axis 137 and each extend in an arcuate direction less than 180 degrees. The first arcuate groove 130 is defined on one side of a top dead center position (TDC) and the second arcuate groove 134 is defined on the opposed side of the TDC position as illustrated in FIG. 3. It is recognized that the plurality of arcuate slots 132 of the first arcuate groove 130 could be connected directly to the respective arcuate slots 120 in the first end portion 112 and that the plurality of arcuate slots 136 of the second arcuate groove 134 could be directly connected to the respective arcuate slots 124 of the first end portion 112 without departing from the essence of the subject invention.

Figure 4:
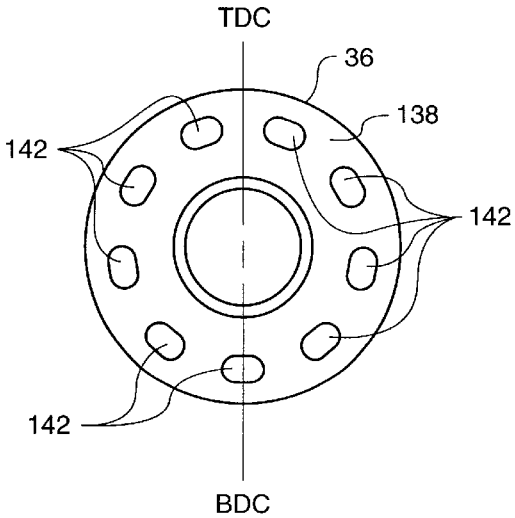
FIG. 4 is a sectional view taken along the line 4—4 of FIG. 1.
Figure 5:
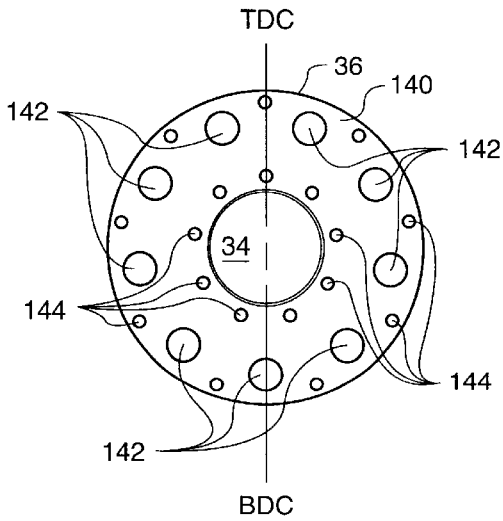
FIG. 5 is a sectional view taken along the line 5—5 of FIG. 1.

The port plate 36 with the bearing assembly 38 disposed thereabout is located in the recess 127 of the camplate 32. The port plate 36 has first and second parallel, opposed faces 138,140 with the first opposed face 138 being in mating contact with the face surface 128 of the second end face portion 114 of the camplate 32. Referring also to FIGS. 4 and 5 which further illustrates the port plate 36, a plurality of equally spaced formed cavities 142 is defined through the port plate 36 between the first and second opposed faces 138,140. The plurality of formed cavities 142 is maintained at a predetermined distance about the second reference axis 137. The predetermined distance from the second reference axis 137 of the plurality of formed cavities 142 is substantially the same as the predetermined radius of the first and second arcuate grooves 130,134 of the second end face portion 114 of the camplate 32. Since the first and second opposed faces 138,140 are parallel and the first opposed face 138 is in mating contact with the face surface 128 of the camplate 32, the angle of the second opposed face 140 of the port plate 36 is at 25 degrees with respect to the end face 74 and the reference plane 129 and the angle could also be within the range of 10 to 35 degrees as set forth previously with respect to the face surface 128 of the camplate 32. A plurality of fastener holes 144 are defined in the second opposed face 140 of the port plate 36 and operative to threadably receive respective ones of a plurality of fasteners 146 (FIG. 1).

The plurality of pistons 40 includes individual pistons 40*a–i*. It is recognized that a different number of pistons and respective blind bores could be used without departing from the essence of the subject invention. Referring to FIG. 8–11 in conjunction with FIG. 1, the piston 40*a* is illustrated in more detail. The piston 40*a* is a unitary member and includes first and end second portions 150,152 with a reference piston axis 154 defined longitudinally therethrough and a perpendicular reference piston plane 155 defined at one end thereof. It is recognized that other known piston assemblies could be used. For example, piston assemblies that include a piston having a shoe pivotably secured thereto. The first end portion 150 of each piston 40*a–i* is slideably disposed in the associated blind bore of the plurality of blind bores 90 to form respective pressure chambers 156 between the first end portion 150 thereof and the bottom surface 93 of each of the blind bores 90. Each of the piston 40*a–i* is the same and functions the same, therefore, only the piston 40*a* will be described in detail.

The first end portion 150 of the piston 40*a* has a peripheral surface 158 extending the length thereof. A balancing slot 160 is defined in the first end portion 150 in the peripheral surface 158 generally adjacent the end of the piston 40*a* distal from the second end portion 152. The balancing slot 160 has a first slot portion 162 near the end of the first end portion with a predetermined width and a second wider slot portion 164 of a predetermined width at a predetermined distance from the end of the first end portion 150 of the piston 40*a*. A cavity 165 is defined in the piston 40*a* along the reference piston axis 154 through the first and second portions 150,152. An orifice 166 is defined in the piston 40*a* extending from the cavity 165 therein to the balancing slot 160. It is recognized that the orifice 166 could be eliminated in some arrangements as noted below.

Figure 11:
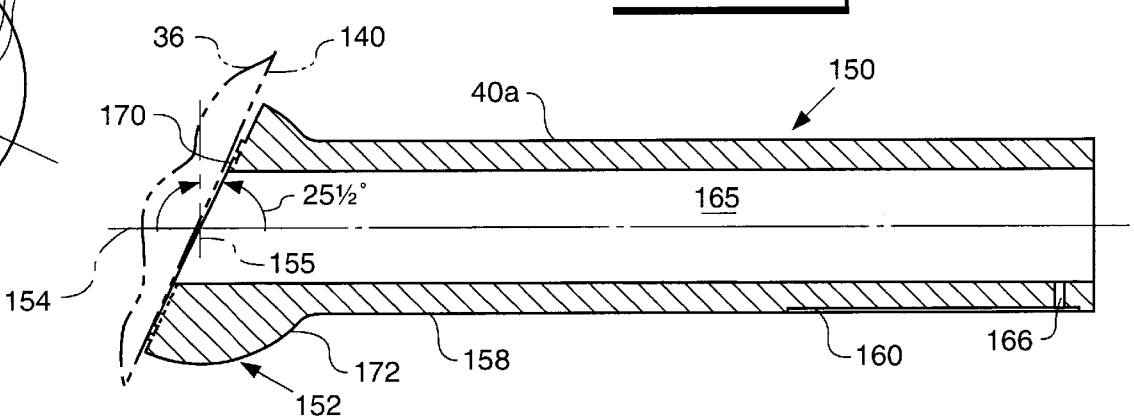
FIG. 11 is sectioned side view of the piston in FIG. 9.
Figure 10:
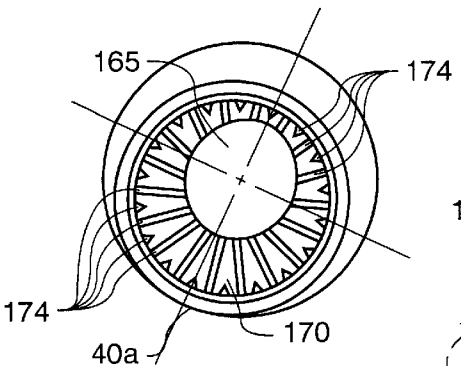
FIG. 10 is an end view of the piston of FIG. 9.

The second end portion 152 of the piston 40*a* is enlarged with respect to the first end portion 150 thereof. A piston face surface 170 is disposed on the second end portion 152 of the piston 40*a* and forms an acute angle with respect to the reference piston plane 155. The piston face surface 170 of each piston 40*a–i* is operative to slideably mate with the second opposed face 140 of the port plate 36 at a location to align the respective cavities 165 with the respective ones of the plurality of cavities 142 in the port plate 36. The acute angle of the piston face surface 170 is zero to one half degree greater than the acute angle formed between the second opposed face 140 of the port plate 36 and the first end portion 112 of the camplate 32. In the subject embodiment, the acute angle of the piston face surface 170 relative to the reference piston plane 155, as illustrated in FIG. 11, is 25½degrees. It is recognized that the acute angle of the piston face surface 170 could be the same as the acute angle formed between the port plate 36 and the reference plane 129. During operation, the piston 40*a* can rotate about the axis 154 and improve alignment of the face 170 thereof relative to the second opposed face 140 of the port plate 36.

The second end portion 152 of the piston 40*a* has a spherical peripheral surface 172 and the piston face surface 170 has a plurality of pressure balancing slots 174 defined therein about the reference piston axis 154. The plurality of pressure balancing slots 174 is operative, in use, to provide a fluid film at the piston face surface 170 for lubrication thereof.

Figure 6:
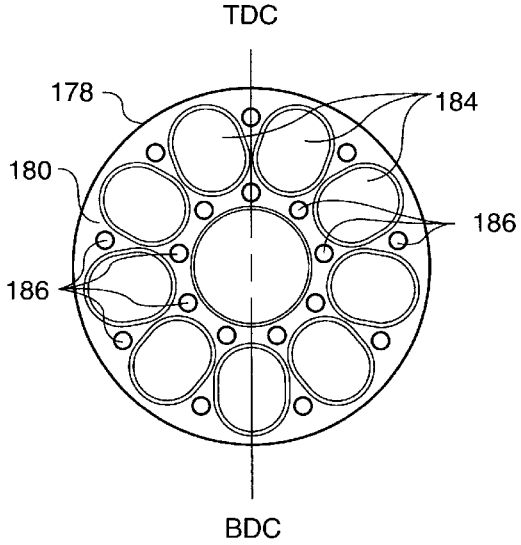
FIG. 6 is a sectional view taken along the line 6—6 of FIG. 1.
Figure 7:
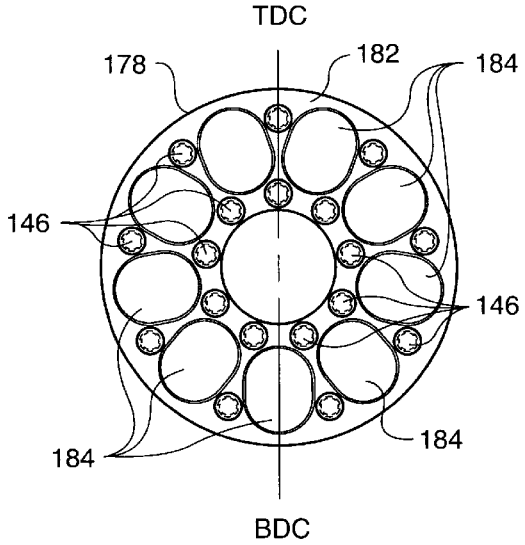
FIG. 7 is a sectional view taken along the line 7—7 of FIG. 1.

Referring to FIGS. 6 and 7 in combination with FIG. 1, a piston retainer member 178 having first and second opposed faces 180,182 is set forth and operative to hold the respective pistons 40*a–i* close to the second opposed face 140 of the port plate 36. A plurality of formed elongated cavities 184 is defined in the retainer member 178 between the first and second opposed faces 180,182. The wall surface of each cavity of the plurality of formed elongated cavities 184 has a spherical shape to mate with the spherical peripheral surface 172 of the second end portion 152 of the pistons 40*a–i*. A plurality of retainer holes 186 are defined in the retainer member 178 and operative to receive respective ones of the plurality of fasteners 146. As illustrated in FIG. 1, each of the pistons 40*a–i* is disposed through the respective ones of the plurality of formed elongated holes 186 and the piston retainer member 178 is secured to the port plate 36 by the plurality of fasteners 146.

Figure 12:
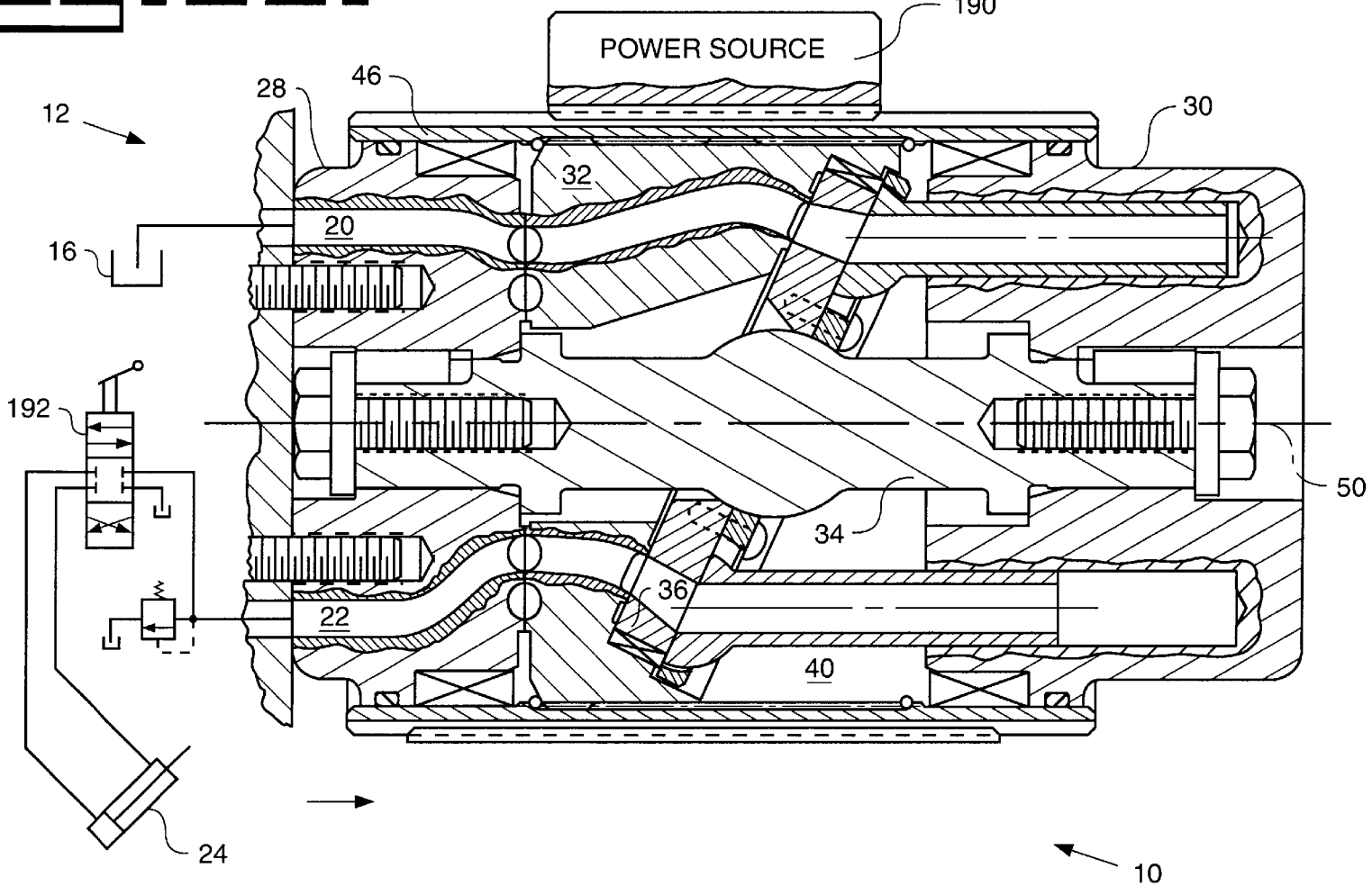
FIG. 12 is a partial diagrammatic and partial schematic sectional view of the embodiment of the subject invention used as a fluid pump in a fluid system.

Referring to FIG. 12, the fluid translating device 10 is used in a fluid system 12 as a fluid pump. All elements of the fluid translating device 10 as used and described in FIGS. 1–11 are the same and will not be described further. Like elements have like element numbers. In the fluid system 12 of FIG. 12, a power source 190 is drivingly connected to the outer input/output member 46 and the first inlet/outlet port 20 is connected to the reservoir 16. The second inlet/outlet port 22 is connected to the working member 24, such as a fluid actuator, through a directional control valve 192. The power source 190 rotates the outer input/output member 46 in the same direction as set forth with that of FIGS. 1–11.

It is recognized that various other components and/or arrangements could be used in the subject fluid system 12 without departing from the essence of the subject invention. For example, the plurality of blind bores 90 in the second member 30 could be through bores with sealed plugs inserted at the end of each bore to establish a blind bore. Likewise, the plurality of fasteners 146 that holds the piston retainer member 178 to the port plate 36 could be replaced by other known methods, such as, by increasing the depth of the recess 127 in the second end portion 114 of the camplate 32 and properly positioning a snap ring groove therein and inserting a snap ring in the snap ring groove to hold the piston retainer member 178 in its proper location. Additionally, the bearing assembly 38 could be a hydrostatically balanced and lubricated bearing.

INDUSTRIAL APPLICABILITY

Figure 8:
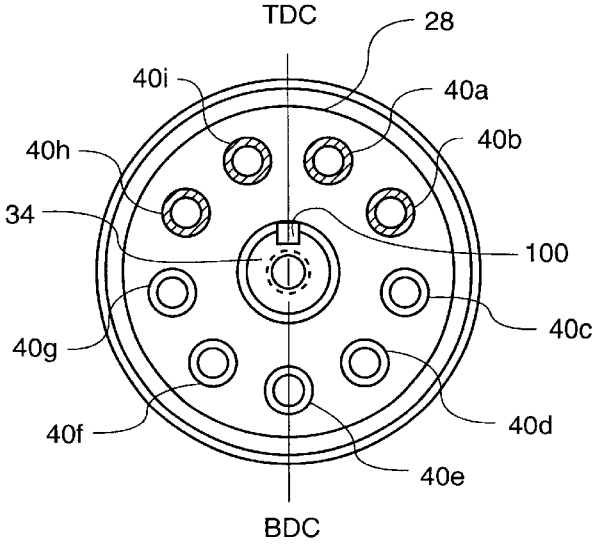
FIG. 8 is a sectional view taken along the line 8—8 of FIG. 1.
Figure 9:
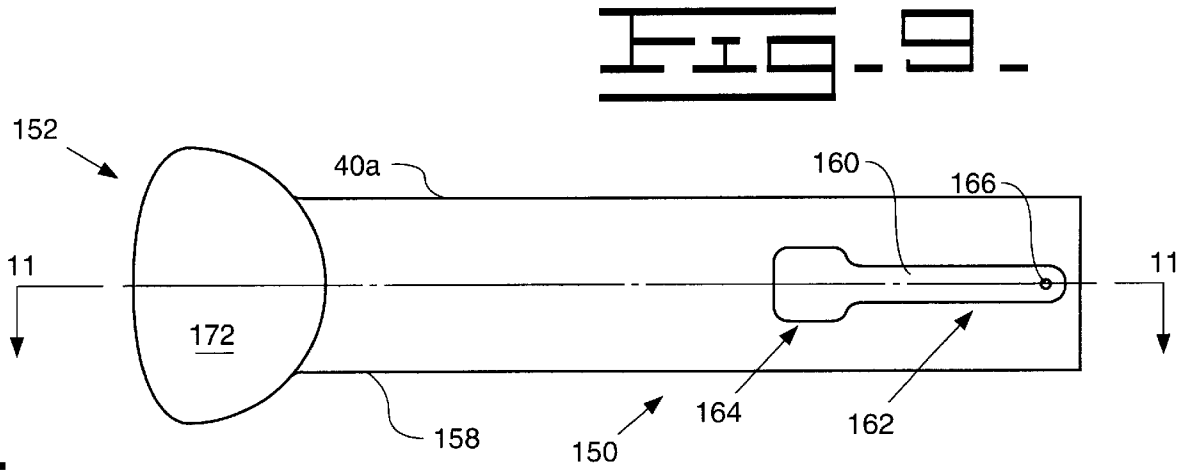
FIG. 9 is an elevational view of a piston taken from FIG. 1.

In the operation of the fluid system 12 set forth in FIGS. 1–11, wherein the fluid translating device 10 is being used as a fluid motor, pressurized fluid from the hydraulic pump 14 is directed, in response to operation of the control valve 18, to the respective pressure chambers 156 located, as viewed in FIG. 8, on the left side of the TDC position. The pressurized fluid is directed from the first inlet/outlet port 20 to the pressure chamber 156 through the first inlet/outlet port 20, first circular groove 76 in the first member 28, the first circular groove 116 in the camplate 32, the arcuate slots 120, the plurality of arcuate slots 132 in the first arcuate groove 130, through the port plate 36, and the associated cavities 165. The force of the pressurized fluid acting on the ends of the associated pistons 40*f–i* results in the camplate 32 rotating in the direction illustrated in FIG. 3. As the camplate 32 rotates, the pistons 40*a–e* move into their associated blind bores 90 expelling the fluid therefrom. The expelled fluid returns to the reservoir 16 through the cavities in the associated pistons 40*a–e,* across the port plate 36, through the plurality of interconnected slots 136 in the second arcuate groove 134, the arcuate slots 124, the second circular groove 118 in the camplate 32, the second circular groove 78 in the first member 28, and the second inlet/outlet port 22. Since the camplate 32 is drivingly secured to the outer input/output member 46, the outer input/output member 46 drives the working member 24. The speed of the working member 24 is controlled in response to the volume of pressurized fluid being directed to the fluid motor 10 by the control valve 18.

As the camplate 32 rotates, the port plate 36 is permitted to nutate about the reference axis 50. The bearing assembly 38 permits rotational movement between the camplate 32 and the port plate 36 while the plurality of formed elongated cavities 184 in the piston retainer member 178 permits relative movement between the plurality of pistons 40 and the second opposed face 140 of the port plate 36.

The piston face surface 170 lays flat against the second opposed face 140 of the port plate 36. The plurality of pressure balancing slots 174 permits an ample amount of lubricating fluid to be maintained between the piston face surface 170 of the respective pistons 40*a–i* and the second opposed face 140 of the port plate 36. It is necessary to maintain the piston face surface 170 flat against the port plate 36 in order to minimize leakage thereacross. In order to offset tolerances between components, the angle of the piston face surface 170 with respect to the reference piston plane 155 and the parallel reference plane 129 is approximately ½degree greater. The respective pistons 40*a–i* rotate slightly within their respective blind bores 90 in response to rotation of the camplate 36 to ensure that the piston face surface 170 remains flat against the port plate 36. The slight rotation of the respective pistons 40*a–i* is automatic since the portion of the piston face surface 170 that touches the second opposed face 140 of the port plate 36 first creates a slight drag force that results in a twisting force on the piston thus slightly rotating the piston to make the face surface 170 lay flat on the port plate 36.

The balancing slot 160 located on the peripheral surface 158 of each piston 40*a–i* operates to balance the forces acting on the respective pistons at the piston face surface 170 attempting to tilt the respective pistons relative to the respective blind bores 90. Pressurized fluid within the respective pressure chambers 156 is directed into the balancing slot 160 through the orifice 166. It is recognized that the orifice 166 could be eliminated and the pressurized fluid in the respective pressure chambers 156 would be directed to the balancing slot 160 via the sliding clearance between the peripheral surface 158 of the piston and the associated blind bore 90. When the respective pistons 40*a–i* are extended from the respective blind bores 90, the force acting on the piston face surface 170 tends to urge the respective pistons 40*a–i,* as viewed in the FIGS. 1, 11 or 12, in a counterclockwise direction. As the piston tips or cants in the bore, fluid enters into the balancing slot 160, either through the orifice 166 and/or around the piston 40*a* due to the larger eccentric clearances and pressurizes the balancing slot 160 which applies a force to the wider slot portion 164 that is larger than the force acting in the first portion 162 thus urging the respective pistons 40*a–i* to re-straighten within the blind bore 90. This improves piston lubrication thus reducing subsequent wear and can actually reduce leakage since the respective pistons have reduced eccentricity.

In the operation of FIG. 12 wherein the fluid translating device 10 is being used as a pump, the power source 190 drivingly rotates the outer input/output member 46 which in turn rotates the camplate 32 in the direction illustrated in FIG. 3. As the camplate 32 rotates, the pistons 40*a–e* on the right side of the TDC position, as viewed in FIG. 8, are urged into the respective blind bores 90 thus forcing pressurized fluid therefrom. The pressurized fluid is directed through the respective cavities 165, across the port plate 36, through the plurality of interconnected slots 136 in the second arcuate groove 134, the arcuate slots 124, the second circular groove 118, the second circular groove 78, the second inlet/outlet port 22, through the directional control valve 192 to the working member 24.

At the same time the pistons 40*f–i* are moving in a direction out of the respective blind bores 90. In order to fill the associated pressure chambers 156, fluid is directed thereto from the reservoir 14 through the first inlet/outlet port 20, the first circular groove 76, the first circular groove 116, the arcuate slots 120, the plurality of interconnected arcuate slots 132 in the first arcuate groove 130, across the port plate 36, and through the cavities 165 in the associated pistons. The remaining operation of the fluid translating pump 10 of FIG. 12 is the same as that described with respect to the operation set forth with respect to FIGS. 1–11.

In view of the above, it is readily apparent that the subject fluid translating device 10 provides a more compact and efficient unit. This is evident, in part, by the fact that the outer input/output member 46 is maintained aligned about the first and second members by the first and second seal and bearing assemblies 42,44 regardless of the forces being applied thereto. Also, by having the first and second members 28,30 secured to a stationary central shaft 34, the fluid translating device is more compact and less costly to produce.

Other aspects, objects and advantages of the subject invention can be obtained from a study of the drawings, the disclosure and the appended claims.

What is claimed is:

1. A fluid translating device, comprising:

a stationary central shaft having first and second end portions and a center portion with a reference axis extending through the first, second, and center portions;

a first member securely connected to the first end portion of the stationary central shaft about the reference axis and having an end face and first and second inlet/outlet ports in communication with the end face thereof;

a second member securely connected to the second end portion of the stationary central shaft about the reference axis and having a face surface and a plurality of equally spaced blind bores defined therein about the reference axis and extending from the face surface thereof parallel to the reference axis;

a camplate rotatably disposed about the reference axis of the stationary central shaft between the first and second members and having a first end face portion in abutting contact with the end face of the first member and a second end face portion angled with respect to the reference axis and having a recess defined therein, a face surface is disposed in the recess and the face surface therein is in communication with the first end face portion thereof;

a port plate having a bearing assembly disposed thereabout and being located within the recess of the camplate, the port plate has first and second opposed faces and a plurality of equally spaced formed cavities defined therein about the reference axis between the first and second opposed faces and disposed with the first opposed face thereof being in mating contact with the face surface of the recess in the camplate;

a plurality of hollow pistons with each piston thereof having first and second end portions with the first end portion being slideably disposed within the respective blind bores of the second member to define pressure chambers therein and the second end portion thereof being in contact with the other opposed face of the port plate; and an outer input/output member disposed about the camplate and the first and second members, the outer input/output member being secured to the camplate and rotatable about the first and second members.

2. The fluid translating device of claim 1 wherein the end face of the first member has first and second spaced apart circular grooves defined therein about the reference axis and the first and second spaced apart circular grooves are in communication with respective ones of the first and second inlet/outlet ports and the first end face portion of the camplate has first and second spaced apart circular grooves defined therein about the reference axis and located in contact with the end face of the first member and adjacent to the respective ones of the first and second circular grooves of the end face of the first member.

3. The fluid translating device of claim 1 wherein the face surface of the second end portion of the camplate has a first arcuate groove extending about the reference axis at a predetermined distance and in communication with the first circular groove of the first end face portion thereof and a second arcuate groove extending about the reference axis at the same predetermined distance of the first arcuate groove and in communication with the second circular groove of the first end face portion thereof.

4. The fluid translating device of claim 3 wherein the first arcuate groove extends an arcuate distance less than 180 degrees and is disposed on one side of the end face thereof.

5. The fluid translating device of claim 4 wherein the second arcuate groove extends an arcuate distance less than 180 degrees and is disposed on the opposed side of the end face thereof.

6. The fluid translating device of claim 5 wherein the plurality of formed cavities in the port plate are disposed at a distance from the reference axis substantially the same as the predetermined distance of the first and second arcuate grooves in the second end portion of the camplate.

7. The fluid translating device of claim 6 including a first seal and bearing arrangement disposed between the first member and the input/output member and a second seal and bearing arrangement disposed between the second member and the input/output member.

8. The fluid translating device of claim 7 wherein the fluid translating device is a fluid motor.

9. The fluid translating device of claim 7 wherein the fluid translating device is a fluid pump.

10. The fluid translating device of claim 1 wherein the end face of the first member is perpendicular to the reference axis and the second opposed face of the port plate forms an acute angle with respect to the end face of the first member in the range of 10 to 35 degrees.

11. The fluid translation device of claim 1 wherein the end face of the first member is perpendicular to the reference axis and the second opposed face of the port plate forms an acute angle with respect to the end face of the first member, wherein the acute angle is 25 degrees.

12. The fluid translating device of claim 1 wherein each piston of the plurality of pistons is a unitary member and has a reference piston axis defined therein extending longitudinally through the first and second end portions with a perpendicular reference piston plane defined at one end thereof.

13. The fluid translating device of claim 12 wherein the second end portion of each piston is enlarged and has a piston face surface angled with respect to the axis of the piston and operative to abut the second opposed face of the port plate at the predetermined distance from the reference axis of the stationary central shaft.

14. The fluid translating device of claim 13 wherein the piston face surface of each piston forms an angle with respect to the reference piston plane of the piston that is greater than the angle formed by the second opposed end face of the port plate and the reference plane of the stationary central shaft.

15. The fluid translating device of claim 14 wherein the angle formed between the piston face surface of each piston and the reference piston plane is approximately one half degree greater than the angle formed between the second opposed surface of the port plate and the reference plane of the stationary central shaft.

16. The fluid translating device of claim 15 wherein a cavity is defined through each piston along the reference piston axis thereof.

17. The fluid translating device of claim 16 wherein the first end portion of each piston has a peripheral surface and a force balancing slot is defined in a portion of the peripheral surface at a location opposed to the piston face surface of the second end portion and near the end of the first end portion thereof.

18. The fluid translating device of claim 17 wherein the force balancing slot extends parallel to the reference axis thereof and is wider at a location furthest from the end of the first end portion.

19. The fluid translating device of claim 17 wherein the force balancing slot is in fluid communication through an orifice with the respective pressure chamber formed in the blind bore.

20. A fluid translating device adapted for use in a fluid system, comprising:

a stationary central shaft having first and second end portions and a center portion with a reference axis defined therein extending through the first, second, and center portions and a reference plane defined therein perpendicular to the reference axis thereof;

a first member securely connected to the first end portion of the stationary central shaft about the reference axis and having an end face with first and second spaced apart circular grooves defined therein about the reference axis and first and second inlet/outlet ports connected to respective ones of the first and second circular grooves;

a second member securely connected to the second end portion of the stationary central shaft about the reference axis and having an end face and a plurality of bores defined therein extending parallel to the reference axis and disposed equally spaced from each other, each bore has a bottom surface at a predetermined distance from the end face of the second member;

a camplate rotatably disposed about the reference axis of the stationary central shaft between the first and second members, the camplate has a first end face portion with first and second spaced apart circular grooves defined therein about the reference axis and located in contact with the end face of the first member and adjacent to the respective ones of the first and second circular grooves of the end face of the first member and a second end face portion angled with respect to the first end face portion and to the reference axis, the second end face portion has a face surface disposed in a recess with a first arcuate groove extending about the reference axis at a predetermined distance and in communication with the first circular groove of the first end face portion thereof and a second arcuate groove extending about the reference axis at the same predetermined distance of the first arcuate groove and in communication with the second circular groove of the first end face portion thereof;

a port plate having opposed faces and a bearing assembly disposed thereabout and being located in the recess of the camplate, the port plate has a plurality of spaced apart formed cavities defined therethrough about the reference axis at the same predetermined distance of the first and second arcuate grooves and is disposed in the recess of the camplate in abutting contact with the face surface in the recess;

a plurality of pistons, each piston of the plurality of pistons having a first end portion, a second end portion and a reference piston axis, the second end portion of each piston is enlarged and has a piston face surface that is in mating contact with the port plate at the predetermined distance from the reference axis of the stationary central shaft and the first and second end portions of each piston has a cavity extending therethrough parallel to the reference piston axis of the respective piston and the first end portion thereof is slideably disposed in the respective bores within the second end member to define a chamber between the first end portion of the piston and the bottom surface of the respective bores;

a hold down mechanism is secured to the port plate and operative to hold the plurality of pistons in intimate contact with the port plate; and an outer input/output member is disposed about and secured to the camplate and is rotatably disposed about the first and second members.

21. The fluid translating device of claim 20 wherein a perpendicular reference piston plane is defined at one end of each piston and the piston face surface of each piston of the plurality of pistons forms an angle with the reference piston plane that is greater than the angle formed by one of the opposed faces of the port plate and the reference plane of the stationary central shaft.

22. The fluid translating device of claim 21 wherein the angle between the piston face surface of each piston and the reference piston plane is approximately one half degree larger than the angle formed by the one opposed face of the port plate and the reference plane of the stationary central shaft.

23. The fluid translating device of claim 22 wherein the first end portion of each piston has a peripheral surface and a force balancing slot is defined in the peripheral surface thereof at a location near the end thereof opposed to the second end portion.

24. The fluid translating device of claim 23 in combination with a fluid system having a power source, a working element and a fluid source.

25. The fluid translating device of claim 24 wherein the fluid translating device is a fluid motor and the input/output member is drivingly connected to the working element and the first inlet/outlet port is connected to the fluid source.

26. The fluid translating device of claim 24 wherein the fluid translating device is a fluid pump and the input/output member is connected to and driven by the power source and the second inlet/outlet port is connected to the working member.

* * * * *